US005294399A

United States Patent [19]

Akiyama

[11] Patent Number: 5,294,399

[45] Date of Patent: Mar. 15, 1994

[54] PREPARATION OF CATHODE STRUCTURES FOR IMPREGNATED CATHODES

[75] Inventor: Yasuhiro Akiyama, Tokyo, Japan

[73] Assignee: NEC Corporation, Tokyo, Japan

[21] Appl. No.: 915,304

[22] Filed: Jul. 20, 1992

[30] Foreign Application Priority Data

Jul. 25, 1991 [JP] Japan ..... 3-186005

[51] Int. Cl.[5] ..... B22F 3/26

[52] U.S. Cl. ..... 419/27; 419/49; 419/8

[58] Field of Search ..... 419/8, 49, 2, 27; 445/50

[56] References Cited

U.S. PATENT DOCUMENTS 3,243,292 5/1962 Hill et al. ..... 75/203
4,601,878 7/1986 Aslund et al. ..... 419/49
4,767,372 8/1988 Bossert et al. ..... 445/50
5,066,454 11/1991 Hanson ..... 419/42
5,096,450 3/1992 Sugimura et al. ..... 445/50

FOREIGN PATENT DOCUMENTS 0409275 1/1991 European Pat. Off. .

*Primary Examiner*—Donald P. Walsh
*Assistant Examiner*—Anthony R. Chi
*Attorney, Agent, or Firm*—Leydig, Voit & Mayer

[57] ABSTRACT

Disclosed is a process for preparing a cathode structure for impregnated cathodes having desired dimensions by a simplified process without experiencing machining etc. A high-melting-point metal powder is introduced into a mold, and heated with the heater to effect isostatic press molding to provide a cathode structure for impregnated cathodes having a predetermined shape and dimensions by one operation.

12 Claims, 2 Drawing Sheets

PREPARATION OF CATHODE STRUCTURES FOR IMPREGNATED CATHODES

BACKGROUND OF THE INVENTION

1. Field of the Invention

This invention relates to a process for preparing a cathode structure for impregnated cathodes used in electric discharge tubes.

2. Description of the Prior Art

Cathode is an essential constituent of electric discharge tubes, upon which efficiency and life of the electric discharge tubes are decided. Characteristics required for the cathodes for electric discharge tubes are as follows:

(a) high electron emission efficiency;

(b) high current density;

(c) uniform emission energy;

(d) stable operation;

(e) long life;

(f) sufficient resistance to the vacuum pressure imparted to the electric discharge tube; and (g) no electron emission at any part other than the predetermined electron emitting surface.

Impregnated cathodes can be given as those having the above-described characteristics.

An impregnated cathode is prepared by impregnating a porous high-melting-point metal base such as of porous tungsten with an electron emitting material comprising a compound oxide based on barium. The thus prepared impregnated cathode is usually mounted on a heater sleeve with a heater accommodated therein. During operation of the cathode, the compound oxide impregnated in the porous metal base is heated by the heater and reduced at the activation temperature into free metals which diffuse throughout the surface of the porous metal base and form a single atomic layer. The thus formed single atomic layer is designed to have greatly reduced work function compared with the tungsten, enabling efficient electron emission.

The cathode structure for such impregnated cathodes has conventionally been prepared in the following manner:

(a) a high-melting-point metal powder is shaped by powder extrusion method and then sintered;

(b) the thus sintered porous high-melting-point metal is infiltrated with an acrylic resin as a lubricant so as to facilitate machining thereof;

(c) upon completion of machining into predetermined dimensions of cathode base, the infiltrated acrylic resin is removed; and (d) the cathode base is soldered or welded onto a heater sleeve.

As described above, fabrication of a cathode structure for impregnated cathodes requires such considerable time, equipments and materials.

According to the above prior art method, an impregnated cathode can be obtained through a long process (molding and sintering→acrylic resin infiltration→machining→acrylic resin removal→bonding), leading to increase in the manufacturing cost and facility cost, disadvantageously. Meanwhile, shaping of the porous high-melting-point metal base includes a molding step and a sintering step, increasing the working time, and besides deformation which occurs during sintering makes it difficult to obtain a desired size of product.

SUMMARY OF THE INVENTION

This invention provides a process for preparing a cathode structure for impregnated cathodes by introducing a high-melting-point metal powder in a mold, followed by isostatic hot press molding. It should be noted here that the high-melting-point metal powder may be subjected to isostatic hot press molding together with a heater sleeve.

BRIEF DESCRIPTION OF THE DRAWINGS

The features of the present invention that are believed to be novel are set forth in the appended claims. The invention, together with the objects and advantages thereof, may best be understood by reference to the following description of the preferred embodiments taken in conjunction with the attached drawings in which:

DETAILED DESCRIPTION OF THE PREFERRED EMBODIMENTS

Figure 1:
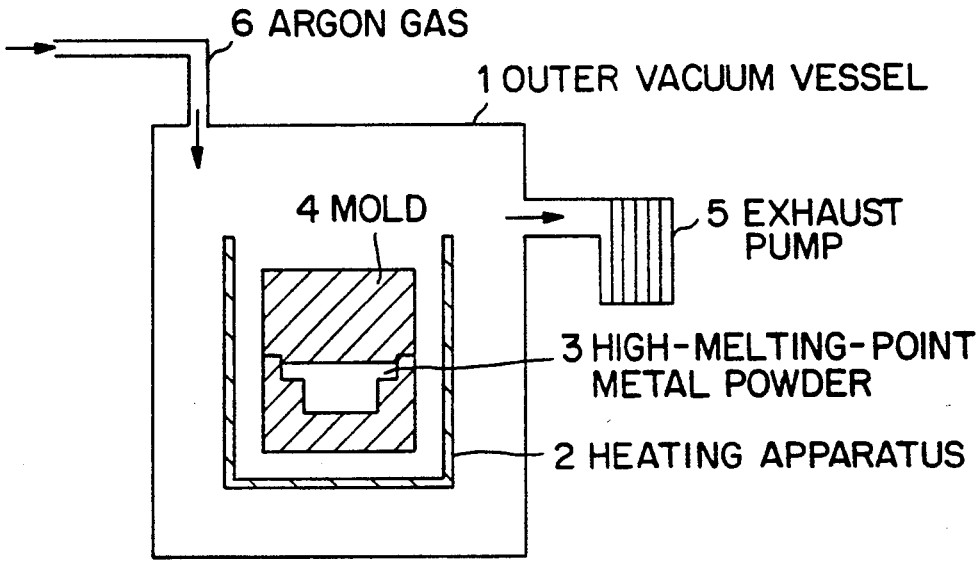
FIG. 1 shows in vertical cross section illustrating the process for preparing a cathode structure for impregnated cathodes according to a first embodiment of this invention.

This invention will now be described specifically referring to the attached drawings. FIG. 1 shows a process for preparing a cathode structure for impregnated cathodes according to the first embodiment of this invention. In this embodiment, an isostatic hot press molding apparatus is used for preparing a cathode structure for impregnated cathodes. A mold 4 filled with a high-melting-point metal powder 3 such as tungsten is set at the center of a heater 2 disposed in an outer vacuum vessel 1. The inside of the outer vacuum vessel 1 is evacuated by an exhaust pump 5 connected to the outer vacuum vessel 1, followed by degassing of the high-melting-point metal powder 3 by the heater 2. Subsequently, a high-pressure argon gas 6 is introduced to carry out isostatic press molding.

Figure 2:
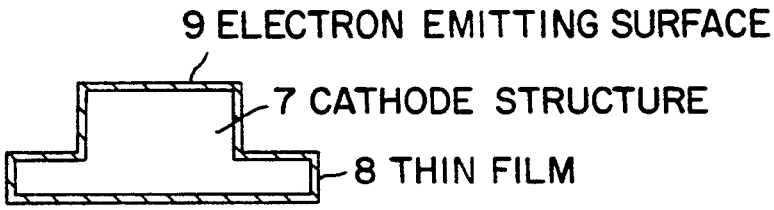
FIG. 2 shows a vertical cross section of a cathode structure for impregnated cathodes prepared according to the method illustrated in FIG. 1.

The entire surface of the thus prepared cathode structure 7 is covered with a thin film 8 of the high-melting-point metal which was formed during molding to a thickness of 1 to 2 μm, as shown in FIG. 2. A predetermined portion of the thin film 8 intended for the electron emitting surface 9 is removed by wet or dry etching, and the etched surface is impregnated with a barium-based compound oxide to give a prescribed size of impregnate cathode structure. Since the thus obtained impregnated cathode structure is entirely covered on the surface with the thin film 8, excluding the electron emitting surface 9, no emission of electrons occurs at the rest of the portions, and thus the present impregnate cathode structure can exhibit excellent electron emission characteristics.

Figure 3:
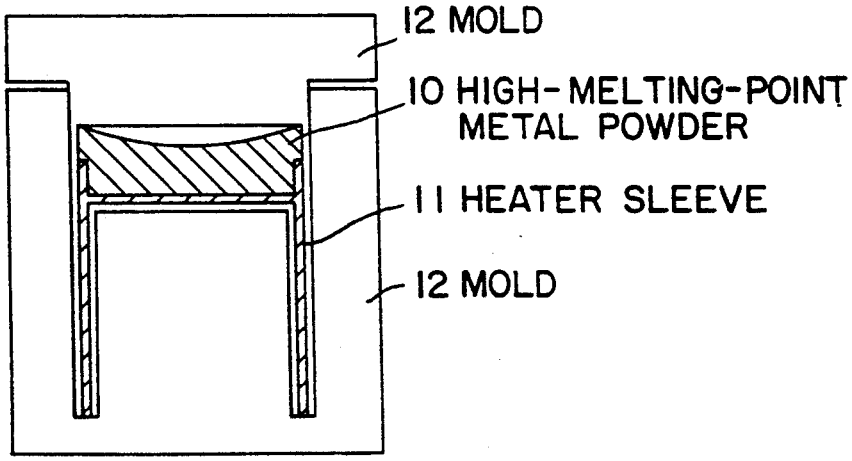
FIG. 3 shows in vertical cross section a second embodiment of this invention.
Figure 4:
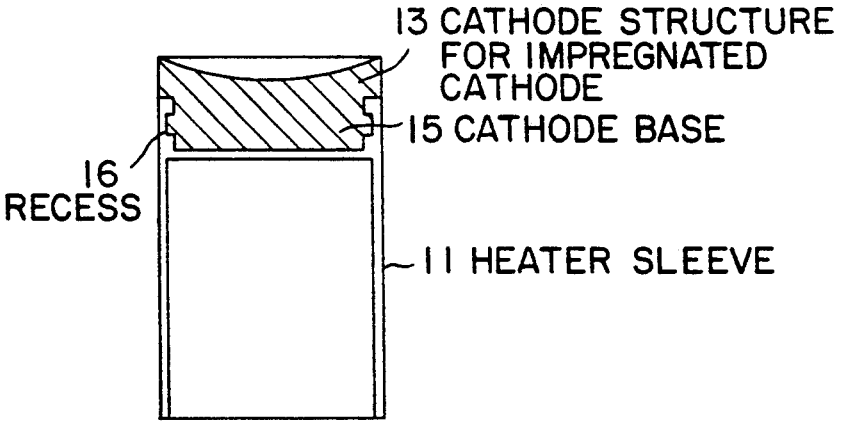
FIG. 4 shows in vertical cross section a cathode structure for impregnated cathodes with a heater sleeve, prepared according to the second embodiment of this invention.

FIG. 3 shows in vertical cross section a cathode structure according to the second embodiment of this invention. A heater sleeve 11 is set in a mold 12 together with a high-melting-point metal powder 10, followed by isostatic hot press molding. As shown in FIG. 4, in the thus obtained cathode structure 13 for impregnated cathodes, the cathode base 15 is formed on the heater sleeve 11, neither requiring soldering or weldering for bonding these two members nor machining into prescribed dimensions. Of course, the bonding of the cathode base 15 onto the heater sleeve 11 can more securely be achieved by providing recesses 16 on the heater sleeve 11.

The thus obtained cathode structure for impregnated cathodes has desired dimensions since isostatic hot press molding is carried out on the heater sleeve, so that the procedures of machining, infiltration with and removal of an acrylic resin and bonding can be omitted, leading to great reduction in the working time and cost, effectively. Besides, since the entire surface of the cathode structure, excluding the electron emitting surface, is covered with a thin film, emission of electrons at the portions other than the electron emitting surface, which causes turbulence in the orbital function, can effectively be prevented.

As has been described heretofore, since the cathode structure for impregnated cathodes according to this invention is prepared by isostatic hot press molding of a high-melting-point metal on a heater sleeve, it enjoys the following effects:

(a) A prescribed size of cathode structure can be molded, requiring no operations including machining, acrylic resin infiltration and removal, and bonding;

(b) Emission of electrons at the portions other than the electron emitting surface can be prevented, since the electron emitting surface is secured by etching; and (c) Migration of impurities, particularly oxygen, potassium or carbon, can be prevented, since the operation process is simplified and molding is carried out after degassing.

Although two embodiments of the present invention have been described herein, it should be apparent to those skilled in the art that the present invention may be embodied in many other specific forms without departing from the spirit or scope of the invention.

Therefore, the present embodiments are to be considered as illustrative and not restrictive and the invention is not to be limited to the details given herein, but may be modified within the scope of the appended claims.

What is claimed is:

1. A process for preparing a cathode structure for impregnated cathodes, comprising the steps of:
   - introducing a high-melting-point metal powder into a mold;
   - performing an isostatic hot press molding process on the mold containing the high melting point metal powder thus forming a cathode structure covered with a thin film of high melting point metal;
   - removing a portion of the thin film from an electron emitting surface of the cathode structure; and
   - impregnating the electron surface of the cathode structure with a barium based compound.

2. The process for preparing a cathode structure for impregnated cathodes according to claim 1, wherein the high-melting-point metal powder is tungsten.

3. The process for preparing a cathode structure for impregnated cathodes according to claim 1, wherein the high-melting-point metal powder is tungsten.

4. The process for preparing a cathode structure for impregnated cathodes according to claim 1, wherein the step of removing a portion of the thin film is performed by dry etching.

5. The process for preparing a cathode structure for impregnated cathodes according to claim 1, wherein the step of removing a portion of the thin film is performed by wet etching.

6. The process for preparing a cathode structure for impregnated cathodes according to claim 1, wherein the electron emitting surface of the cathode is impregnated with a barium oxide compound.

7. The process for preparing a cathode structure for impregnated cathodes according to claim 1, wherein the step of performing an isostatic hot press molding process further includes the steps of:
   - placing the mold in a vacuum vessel;
   - degassing the high-melting-point metal powder by heating the mold; and
   - injecting pressurized gas into the vacuum vessel.

8. A process for preparing a cathode structure for impregnated cathodes comprising the steps of:
   - selecting a mold;
   - placing a heater sleeve in the mold;
   - introducing a high-melting-point metal powder into the mold;
   - performing an isostatic hot press molding process on the mold thus forming a cathode structure covered with a thin film of high-melting-point metal;
   - removing a portion of the thin film from an first surface of the cathode structure; and
   - impregnating the first surface of the cathode structure with a barium based compound.

9. The process for preparing a cathode structure for impregnated cathodes according to claim 1, wherein the step of removing a portion of the thin film is performed by dry etching.

10. The process for preparing a cathode structure for impregnated cathodes according to claim 1, wherein the step of removing a portion of the thin film is performed by wet etching.

11. The process for preparing a cathode structure for impregnated cathodes according to claim 1, wherein the electron emitting surface of the cathode is impregnated with a barium oxide compound.

12. The process for preparing a cathode structure for impregnated cathodes according to claim 1, wherein the step of performing an isostatic hot press molding process further includes the steps of:
   - placing the mold in a vacuum vessel;
   - degassing the high-melting-point metal powder by heating the mold; and
   - injecting pressurized gas into the vacuum vessel.

* * * * *